US011492712B2

(12) United States Patent
Fukuchi et al.

(10) Patent No.: US 11,492,712 B2
(45) Date of Patent: Nov. 8, 2022

(54) ANODE MOUNTING MEMBER OF FLUORINE ELECTROLYTIC CELL, FLUORINE ELECTROLYTIC CELL, AND METHOD FOR PRODUCING FLUORINE GAS

(71) Applicant: SHOWA DENKO K.K., Tokyo (JP)

(72) Inventors: Yohsuke Fukuchi, Yokohama (JP); Nozomi Inoue, Kawasaki (JP); Hiroshi Kobayashi, Yokohama (JP)

(73) Assignee: SHOWA DENKO K.K., Tokyo (JP)

( * ) Notice: Subject to any disclaimer, the term of this patent is extended or adjusted under 35 U.S.C. 154(b) by 509 days.

(21) Appl. No.: 16/624,938

(22) PCT Filed: Jun. 26, 2018

(86) PCT No.: PCT/JP2018/024186

§ 371 (c)(1),
(2) Date: Dec. 20, 2019

(87) PCT Pub. No.: WO2019/004208

PCT Pub. Date: Jan. 3, 2019

(65) Prior Publication Data

US 2021/0332487 A1 Oct. 28, 2021

(30) Foreign Application Priority Data

Jun. 30, 2017 (JP) ..... JP2017-129277

(51) Int. Cl.
*C25B 9/63* (2021.01)
*C25B 9/17* (2021.01)
(Continued)

(52) U.S. Cl.
CPC ..... *C25B 9/63* (2021.01); *C25B 1/02* (2013.01); *C25B 1/245* (2013.01); *C25B 9/17* (2021.01); *C25B 15/08* (2013.01)

(58) Field of Classification Search
CPC ..... C25B 1/245; C25B 9/63; C25B 9/65
See application file for complete search history.

(56) References Cited

U.S. PATENT DOCUMENTS 5,084,156 A 1/1992 Iwanaga et al.
5,688,384 A 11/1997 Hodgson et al.
(Continued)

FOREIGN PATENT DOCUMENTS

CN 1137808 A 12/1996
CN 1517451 A 8/2004
(Continued)

OTHER PUBLICATIONS

Notice of Allowance dated Apr. 28, 2021 from the Korean Intellectual Property Office in KR Application No. 10-2019-7037085.
(Continued)

*Primary Examiner* — Brian W Cohen
(74) *Attorney, Agent, or Firm* — Sughrue Mion, PLLC

(57) ABSTRACT

An anode mounting member (16) of a fluorine electrolytic cell including: a plurality of stacked annular packings surrounding a sidewall of a cylindrical anode packing gland (14); a cylindrical exterior member (23) surrounding an outer periphery of the packings; and an annular fastening member (24) that fastens the plurality of packings and the exterior member (23) to the anode packing gland (14), wherein among the packings a first ceramic packing (17) is located at an end of the longitudinal direction on an electrolyte tank side, and a second resin packing (18) is adjacent to the first packing (17), central axes of the anode packing gland (14) and the exterior member (23) coincide, an inner diameter (17*r*) is 0.2 mm to 1.0 mm larger than an outer diameter (14R), and an outer diameter (17R) is 0.2 mm to 1.0 mm smaller than an inner diameter (23*r*).

11 Claims, 2 Drawing Sheets

(51) Int. Cl.

| | |
|---|---|
| ***C25B 1/02*** | (2006.01) |
| ***C25B 1/245*** | (2021.01) |
| ***C25B 15/08*** | (2006.01) |

(56) References Cited

U.S. PATENT DOCUMENTS

| | | | |
|---|---|---|---|
| 6,210,549 | B1 | 4/2001 | Tharp |
| 2004/0149570 | A1 | 8/2004 | Hiraiwa et al. |
| 2006/0113186 | A1 | 6/2006 | Hodgson et al. |
| 2008/0128270 | A1 | 6/2008 | Hiraiwa et al. |
| 2012/0168318 | A1 | 7/2012 | Ueno et al. |

FOREIGN PATENT DOCUMENTS

| | | | |
|---|---|---|---|
| CN | 1665962 | A | 9/2005 |
| CN | 2895439 | Y | 5/2007 |
| JP | 50-002931 | U | 1/1975 |
| JP | 03-140488 | A | 6/1991 |
| JP | 2004-244724 | A | 9/2004 |
| JP | 3642023 | B | 4/2005 |
| JP | 4083672 | B | 4/2008 |
| KR | 10-2012-0064101 | A | 6/2012 |
| TW | 513751 | B | 12/2002 |

OTHER PUBLICATIONS

Office Action dated May 20, 2021 from the China National Intellectual Property Administration in CN Application No. 201880042519.2.

S. P. Vavalides et al., "High-Capacity, Long-Life Fluorine Cell", Industrial and Engineering Chemistry, 1958, pp. 178-180, vol. 50, No. 2.

International Search Report for PCT/JP2018/024186 dated Aug. 7, 2018 [PCT/ISA/210].

Taiwanese Office Action for TW107122039 dated Mar. 20, 2019.

ANODE MOUNTING MEMBER OF FLUORINE ELECTROLYTIC CELL, FLUORINE ELECTROLYTIC CELL, AND METHOD FOR PRODUCING FLUORINE GAS

CROSS REFERENCE TO RELATED APPLICATIONS

This application is a National Stage of International Application No. PCT/JP2018/024186 filed Jun. 26, 2018, claiming priority based on Japanese Patent Application No. 2017-129277 filed Jun. 30, 2017, the content of which is incorporated herein by reference.

TECHNICAL FIELD

The present invention relates to an anode mounting member of a fluorine electrolytic cell, a fluorine electrolytic cell, and a method for producing fluorine gas.

BACKGROUND ART

At present, fluorine gas is most industrially produced by a method in which KF-2HF molten salt is heated to 70° C. to 90° C. and electrolyzed. In this method, fluorine gas is generated from an anode portion and hydrogen gas is generated from a cathode portion. In general, in an electrolytic cell that generates fluorine gas by electrolysis of KF-2HF molten salt, amorphous carbon is used as an anode.

Fluorine has the highest electronegativity among all elements and is extremely reactive. Therefore, fluorine gas reacts violently with various compounds to form fluorides. For these reasons, materials that can be used for a part which is in direct contact with fluorine gas, such as an inner surface of an electrolytic cell, an electrode part, or a support portion thereof are limited. Examples of the materials that can be used include metals such as nickel, copper, lead, iron, and aluminum or alloys thereof, whose surfaces are passivated with fluorine.

In addition, according to a report of the American Society for Hygiene, fluorine gas is a very harmful substance with an allowable concentration of 1 ppm or less, and is a substance that requires careful handling. Therefore, in order to prevent the fluorine gas from leaking, an anode mounting member needs to have corrosion resistance to the fluorine gas and also needs to have electrical insulation from an electrolyte tank. Therefore, the aforementioned metal material cannot be used for the anode mounting member as a sealing material, and a fluorine-based resin such as polytetrafluoroethylene is often used as an alternative sealing material. Non-Patent Document 1 discloses an example using a polytetrafluoroethylene gasket.

However, it does not indicate that the fluorine-based resin such as polytetrafluoroethylene is a material completely inert to the fluorine gas, and the fluorine-based resin may be eroded by fluorine gas in an oxidation reaction to be thinned. In this case, a sealing property of the anode mounting member is lost, and there is a concern that the fluorine gas leaks to the outside of the electrolytic cell.

In order to solve these problems, Patent Document 1 discloses an anode mounting member of a fluorine electrolytic cell having a structure sealed with a seal reinforcing material which is ceramic such as alumina and a fluororesin sealing material such as polytetrafluoroethylene. In this structure, the seal reinforcing material which is ceramic can prevent erosion of the fluororesin seal material which is caused by fluorine and can reduce leakage of the fluorine gas. In addition, Patent Document 2 proposes a seal structure in which calcium fluoride is added to polytetrafluoroethylene in order to improve resistance of polytetrafluoroethylene to fluorine gas.

CITATION LIST

Patent Literature

[Patent Document 1] Japanese Patent No. 3642023
[Patent Document 2] Japanese Patent No. 4083672

Non-Patent Literature

[Non-Patent Document 1] Industrial and Engineering Chemistry, 50, (1958), P178

DISCLOSURE OF INVENTION

Technical Problem

However, in the technique of the related art as described above, in some cases, the fluorine gas may not be sufficiently prevented from leaking to the outside of an anode chamber. The present invention has been made in view of the above circumstances, and discloses an anode mounting member of a fluorine electrolytic cell capable of sufficiently preventing fluorine from leaking to the outside of an anode chamber, and further, a fluorine electrolytic cell including the anode mounting member for a fluorine electrolytic cell, and a method for producing fluorine gas using the fluorine electrolytic cell.

Solution to Problem

The present inventors have found that, regarding mixed gas of fluorine gas and oxygen gas, when gaps from a first packing to an exterior member and an anode packing gland are 0.1 mm or more and 1.0 mm or less, preferably 0.2 mm or more and 0.8 mm or less, a combustion reaction does not proceed even in a case where the mixed gas of the fluorine gas and the oxygen gas is in contact with fluororesin, and the present inventors have completed the present invention. That is, the present invention adopts the following means.

(1) According to a first aspect of the present invention, there is provided an anode mounting member of a fluorine electrolytic cell including: a plurality of annular packings which surround a sidewall of a cylindrical anode packing gland and are stacked along a longitudinal direction thereof; a cylindrical exterior member which surrounds an outer periphery of the packings; and an annular fastening member which fastens the packings and the exterior member to the anode packing gland, in which among the packings, a first packing which is located at an end of the longitudinal direction on an electrolyte tank side is made of a ceramic material, and a second packing which is adjacent to the first packing is made of resin, central axes of the anode packing gland and the exterior member coincide, an inner diameter of the first packing is 0.2 mm to 1.0 mm larger than an outer diameter of the anode packing gland, and an outer diameter of the first packing is 0.2 mm to 1.0 mm smaller than an inner diameter of the exterior member.

The anode mounting member of a fluorine electrolytic cell of the first aspect preferably has the following features of (2) and (3). The features of (2) and (3) are also preferably used in combination.

(2) In the anode mounting member of a fluorine electrolytic cell according to (1), the first packing is preferably made of one or more ceramic materials selected from alumina, calcium fluoride, potassium fluoride, yttria, and zirconia.

(3) In the anode mounting member of a fluorine electrolytic cell according to (1) or (2), the second packing is preferably made of at least one or more resins selected from the group consisting of polytetrafluoroethylene, tetrafluoroethylene-perfluoroalkyl vinyl ether copolymer, tetrafluoroethylene-hexafluoropropylene copolymer, tetrafluoroethylene-ethylene copolymer, polyvinylidene fluoride, polychlorotrifluoroethylene, chlorotrifluoroethylene-ethylene copolymer, and fluororubber.

(4) According to a second aspect of the present invention, there is provided a fluorine electrolytic cell including: the anode mounting member of a fluorine electrolytic cell according to any one of (1) to (3).

(5) According to a third aspect of the present invention, there is provided a method for producing fluorine gas in which the fluorine electrolytic cell according to (4) is used.

(6) In the anode mounting member of a fluorine electrolytic cell according to any one of (1) to (3), a thickness of the first packing is preferably 0.2 to 1.5 times an inner diameter of the second packing.

(7) In the anode mounting member of a fluorine electrolytic cell according to any one of (1) to (3) and (6), a thickness of the second packing is preferably 1.0 mm to 10 mm.

(8) The fluorine electrolytic cell according to (4) preferably includes an anode; a cylindrical anode packing gland; and an electrolyte tank.

(9) The method for producing fluorine gas according to (5) preferably includes a step of electrolyzing a KF-2HF electrolyte to generate fluorine gas from an anode and hydrogen gas from a cathode.

(10) The method for producing fluorine gas according to (9) preferably includes a step of replenishing hydrogen fluoride to the electrolyte.

(11) In the method for producing fluorine gas according to (9) or (10), oxygen is preferably generated together with the fluorine gas.

Advantageous Effects of Invention

According to the present invention, damage to a first packing and burning of a second packing, due to fluorine gas, particularly due to fluorine gas generated at an initial stage of electrolysis, are prevented from occurring. As a result, an anode mounting member of a fluorine electrolytic cell, that has a sufficient effect of preventing fluorine from leaking to the outside of an anode chamber, can be obtained. Furthermore, when using a fluorine electrolytic cell which includes the anode mounting member of a fluorine electrolytic cell, it is possible to stably produce fluorine gas by electrolysis for a long period of time from the initial stage of electrolysis.

BEST MODE FOR CARRYING OUT THE INVENTION

Figure 1:
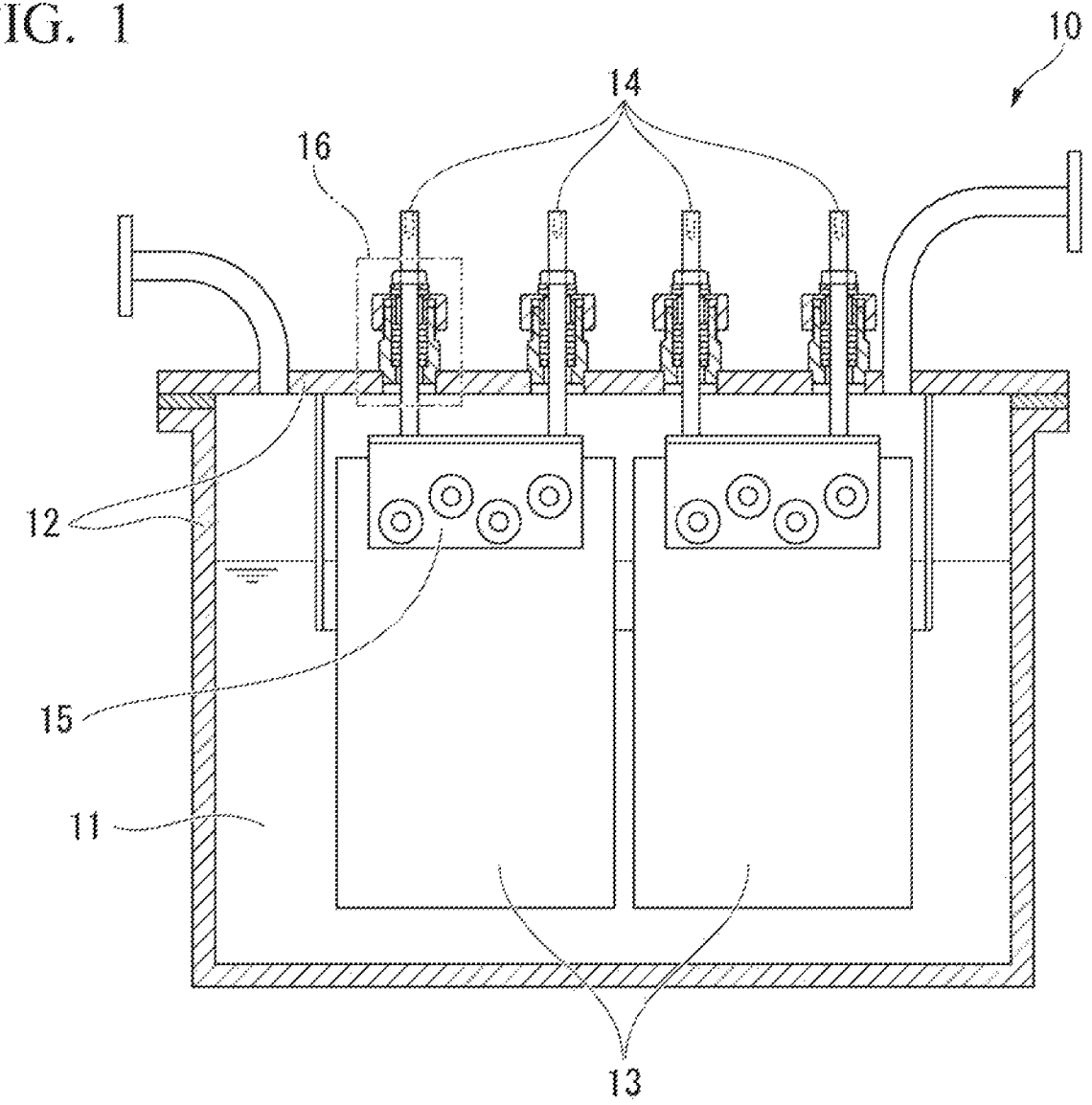
FIG. 1 is a schematic sectional view of a fluorine electrolytic cell according to a preferred embodiment of the present invention.

The present invention relates to an anode mounting member of a fluorine electrolytic cell, in which a first packing is attached to a site, which is in contact with fluorine gas containing oxygen gas generated in an electrolyte tank body and an anode, in a support portion of the anode mounting member of a fluorine electrolytic cell, and a combustion reaction of a second packing which is provided at a site which contacts with the first packing and the electrolyte tank body can be prevented from occurring, a fluorine electrolytic cell including the anode mounting member of a fluorine electrolytic cell, and a method for producing fluorine gas using the fluorine electrolytic cell.

Hereinafter, after describing the background to the present invention, configurations of preferred examples of an anode mounting member of a fluorine electrolytic cell according to an embodiment to which the present invention is applied and a fluorine electrolytic cell including the same will be described in detail using drawings.

In the drawings used in the following description, to make features easier to understand, for the sake of convenience, a feature part may be enlarged and shown in some cases. The dimensional ratio of each component may be the same as or different from that of an actual one. In addition, in the following description, a material, a dimension, and the like to be exemplified are preferred examples. The present invention is not limited only to these, and can be performed with appropriate modifications within the scope without changing the gist thereof. That is, the number, a position, a size, a material, and the like can be omitted, added, changed, replaced, or exchanged without departing from the spirit of the present invention.

[Circumstances Leading to the Present Invention]

FIG. 1 shows a fluorine electrolytic cell. It has been found that an anode mounting member of a fluorine electrolytic cell having a general structure as shown in FIG. 1, that can be attached to the fluorine electrolytic cell, exhibits generally stable performance and can prevent fluorine from leaking. However, as a result of investigations by the present inventors, it has been newly found that sometimes the first packing is damaged and the second packing is burned out particularly in an initial stage of electrolysis. The present inventors investigated this phenomenon in detail. In FIG. 1, an upper left pipe is a hydrogen discharge line, and an upper right pipe is a fluorine gas discharge line. A thing surrounding an upper portion of the anode is a partition wall for partitioning generated gas in the electrolytic cell. Although a cathode is not shown in FIG. 1, an electrolytic cell body itself may be considered as the cathode, in order to understand easier.

The anode mounting member of the present invention can be preferably used for the fluorine electrolytic cell as shown in FIG. 1.

Then, it was found that the aforementioned phenomenon occurs with high frequency when the amount (a proportion) of water contained in an electrolyte is large. When embodying a technique of the related art, it is considered that the amount of water in the electrolyte was relatively small, and influence of the phenomenon was not observed. As a result of examinations by the present inventors, in a case where an electrolyte having a relatively large amount of water is used, both the techniques shown in the cited Patent documents 1 and 2 had no sufficient effect on leakage of fluorine gas.

The electrolyte used for fluorine electrolysis is prepared, for example, by adding hydrogen fluoride to KF-HF. Therefore, electrolyte contains a certain amount of water. When the electrolyte contains water, oxygen gas is generated simultaneously with fluorine gas, from the anode. As the amount of water in the electrolyte increases, the amount of oxygen gas generated simultaneously with the fluorine gas increases. When continuing the electrolysis, the amount of water in the electrolyte decreases, and the amount of oxygen gas generated decreases. However, it is necessary to replenish hydrogen fluoride consumed by electrolysis. Therefore, in a case where the hydrogen fluoride with which the replenishment is performed contains water, the amount of water in the fluorine electrolyte increases again. Like this, there is a possibility that fluorine gas to be generated may always contain oxygen gas although there is a difference in the amount thereof.

In order to confirm that the cause of phenomenon wherein the techniques shown in cited Patent documents 1 and 2 had no sufficient effect on leakage of fluorine gas is the oxygen gas contained in fluorine gas, the present inventors conducted experiments. Specifically, the present inventors placed polytetrafluoroethylene under a condition of fluorine gas or fluorine gas containing oxygen gas, and investigated behavior thereof.

When 100% fluorine gas was brought into contact with the polytetrafluoroethylene at normal pressure and an ambient temperature was raised, combustion of polytetrafluoroethylene started when the ambient temperature reached approximately 220° C. For comparison, 100% oxygen gas was brought into contact with the polytetrafluoroethylene at normal pressure and an ambient temperature was raised to approximately 220° C. However, polytetrafluoroethylene did not burn under the condition.

From these facts, even in a case where a mixed gas of fluorine gas and oxygen gas are brought into contact with the polytetrafluoroethylene at normal pressure and an ambient temperature is raised, it is predicted that the combustion will start at approximately 220° C. at which 100% fluorine gas started to be burned, or at 220° C. or higher. However, the present inventors have conducted the same experiment on the mixed gas of fluorine gas and oxygen gas and found that the combustion start temperature of the polytetrafluoroethylene varies depending on a mixing composition of the fluorine gas and the oxygen gas.

That is, the combustion temperature of the polytetrafluoroethylene is approximately 180° C. at 4 mol % oxygen gas/96 mol % fluorine gas, and the combustion start temperature of the polytetrafluoroethylene decreased to 140° with 8 mol % oxygen gas/92 mol % fluorine gas.

Similarly, it became clear by experiment that a combustion temperature of vinylidene fluoride rubber (Viton (trademark)), which is a fluorine-based rubber, may also decrease as an oxygen gas concentration in the fluorine gas increases, as in the polytetrafluoroethylene. Non-fluorine rubber (such as Neoprene (trademark) and natural rubber) originally has a low combustion start temperature with 100% fluorine gas. However, when oxygen gas is mixed to the fluorine gas, the combustion start temperature is further decreased.

Like this, the present inventors have found that, in a case where the oxygen gas is mixed to the fluorine gas, the influence on the resin such as polytetrafluoroethylene starts at a lower temperature. A mechanism by which combustion support (oxidation power) increases by mixing the fluorine gas and the oxygen gas is unknown. However, the fluorine electrolysis temperature in KF-2HF molten salt is approximately 90° C., and in the initial stage of electrolysis, a large amount of oxygen is generated due to the water in the electrolyte. Therefore, it can be estimated that the influence on the resin material used for an electrode mounting member also increases.

Based on these facts, the present inventors examined the case of Patent Document 1. Patent Document 1 discloses that a sealing material such as polytetrafluoroethylene is shielded with a sealing material made of ceramic so that the fluorine gas and the sealing material hardly come into contact with each other, whereby the sealing portion is prevented from erosion caused by the fluorine gas. Such a structure usually exhibits a favorable effect. However, in the example of Patent Document 1, inconvenience occurs when the fluorine gas containing a large amount of oxygen comes into contact with a material such as polytetrafluoroethylene at the beginning of electrolysis (pre-electrolysis). The structure of Patent Document 1 can obtain an effect of preventing the fluorine gas from leaking, since a contact area between the fluorine gas and the sealing material is extremely small. However, in a case of fluorine gas containing oxygen gas, a sufficient effect may not be exhibited in some cases. That is, in a fluorine electrolytic cell having a plurality of anodes, gas leakage may occur in some of the anode mounting members in the structure of Patent Document 1. It is considered that such a case is caused because the fluorine gas containing oxygen gas has an undesirable effect such as swelling deformation at a lower temperature on the resin material such as polytetrafluoroethylene. That is, it is estimated that since the presence of oxygen gas in the fluorine gas causes the resin sealing material to swell, stress is generated in the seal reinforcing material and the sealing reinforcing material is easily broken. Furthermore, it is also estimated that, in some cases, the seal reinforcing material may collapse and the fluororesin sealing material may be exposed. Like this, it is estimated that it will occur that the resin sealing material is eroded as a result by the fluorine gas containing oxygen gas.

On the other hand, in the case of Patent Document 2, there is proposed a seal structure in which calcium fluoride is added to polytetrafluoroethylene in order to improve resistance of polytetrafluoroethylene to fluorine gas. However, even when the polytetrafluoroethylene is configured to contain the calcium fluoride, if the fluorine gas is in a state of including the oxygen gas, there is a possibility that the combustion reaction may proceed even at an electrolysis temperature. Therefore, a sufficient effect may not be exhibited as a seal structure in some cases.

In order to avoid that the electrolyte contains water, it is ideal to take various steps such as removal of water. However, these countermeasures mean an increase in economic burden. Therefore, a structure of an anode mounting member of a fluorine electrolytic cell, which can show stable performance even in electrolysis wherein an electrolyte containing water is used, is required.

The present inventors intensively studied to solve the problem. As a result, it was found that in a case where, in a support portion of the anode mounting member of a fluorine electrolytic cell, the first packing made of ceramic is mounted on a site which is in contact with fluorine gas containing oxygen gas, which is generated in an electrolyte tank body and an anode, and the second packing made of resin is mounted adjacent to the first packing, when gaps from the first packing to the anode packing gland and the exterior member is set to 0.1 mm or more and 1.0 mm or less, preferably 0.2 mm or more and 0.8 mm or less, the problems described above can be solved, that is, it is possible to prevent the first packing from being damaged or the fluorine gas from leaking, and the present invention was completed.

[Configuration of Anode Mounting Member of Fluorine Electrolytic Cell and Fluorine Electrolytic Cell]

FIG. 1 is a schematic sectional view of a fluorine electrolytic cell 10 according to an embodiment of the present invention. The fluorine electrolytic cell 10 includes an electrolyte tank 12 in which the electrolyte 11 (such as KF-2HF molten salt) that is a raw material for electrolysis is contained, an anode body 13 from which fluorine is generated by the electrolysis, an anode packing gland 14 for flowing a current for the electrolysis to the anode body 13, an anode body fastening member 15 for fastening the anode body 13 to the anode packing gland 14, and an anode mounting member 16 of a fluorine electrolytic cell for supporting the anode packing gland 14.

Any size of the electrolyte tank 12 can be used. For example, it is possible to use a solution tank having a size that allows approximately 500 to 800 L of the electrolyte 11 to be contained, for example, a width of about 2 to 3 m, a depth of about 1 m, and a height of about 0.8 m. Examples of a constituent material of the electrolyte tank 12 include monel or steel (carbon steel; CS).

The anode packing gland (anode post) 14 preferably has a cylindrical shape, and a diameter of a cross section perpendicular to the longitudinal direction is preferably about 15 mm or more and 35 mm or less. The constituent material of the anode packing gland 14 can be selected as necessary, and examples thereof can include copper, monel, nickel, and steel.

The anode body 13 can be selected as necessary, and a carbon electrode and the like made of a carbon material, for example, of approximately 30 cm×50 cm×7 cm, is preferably used. In general, about 16 to 24 sheets of carbon electrodes are attached to one fluorine electrolytic cell 10. The number of sheets to be attached is adjusted according to a size of the electrolytic cell 10. Although FIG. 1 shows a case where two sheets of carbon electrodes are attached, other numbers, for example, 16 to 24 sheets of carbon electrodes, can be attached. It is also possible to configure an anode assembly by combining the fastening member, the mounting member, and the packing gland with a plurality of anodes.

For example, a preferable amount of preferable electrolyte, for example, about 1.5 t of electrolyte 11 which is KF-2HF, is placed in the electrolyte tank 12, and at a preferable electrolysis temperature and a current value, for example, at an electrolysis temperature of 70° C. to 90° C. and a current value of 500 to 7000 A, electrolysis is performed to generate fluorine gas and hydrogen gas, and hydrogen fluoride is supplied as needed. Accordingly, the fluorine can be produced continuously. The fluorine electrolytic cell 10 can include the anode mounting member 16 of a fluorine electrolytic cell for supporting the carbon electrode that generates fluorine, at each of a plurality of locations. The electrolysis temperature is preferably 70° C. to 100° C., and more preferably 80° C. to 90° C. The current value is preferably 700 to 6000 A, and more preferably 1000 to 5000 A.

Figure 2A:
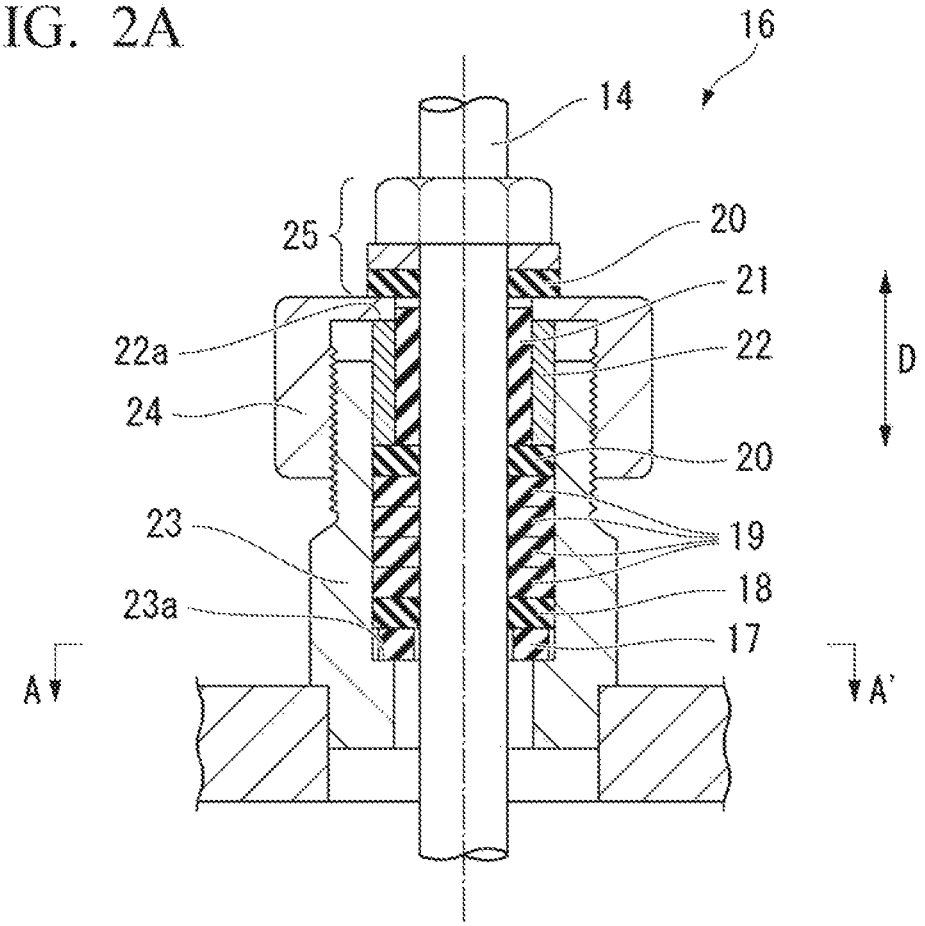
FIG. 2A is a schematic longitudinal sectional view of an anode mounting member of a fluorine electrolytic cell according to a preferred embodiment of the present invention.
Figure 2B:
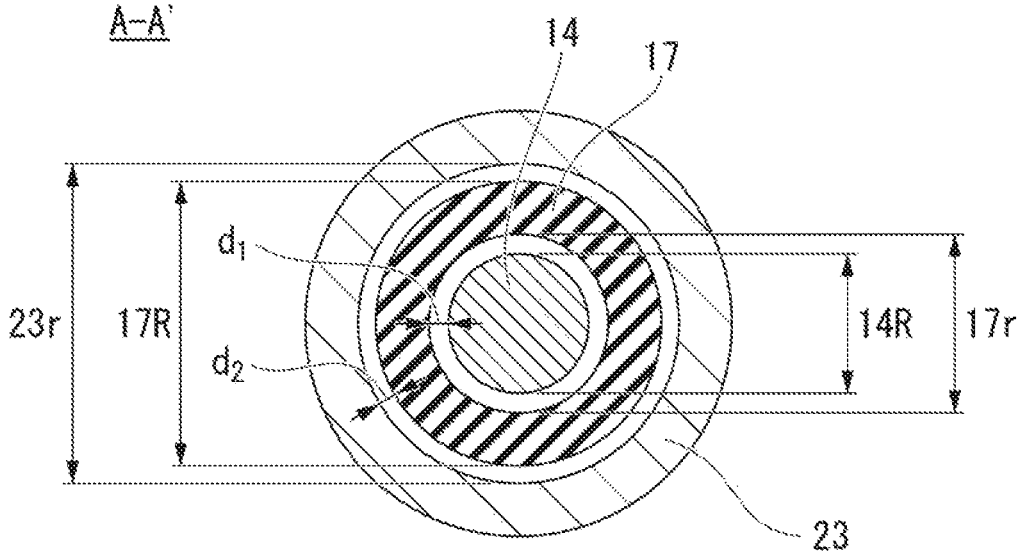
FIG. 2B is a schematic vertical cross sectional view of an anode mounting member of a fluorine electrolytic cell according to a preferred embodiment of the present invention.

FIGS. 2A and 2B are sectional enlarged views of the anode mounting member 16 of a fluorine electrolytic cell in FIG. 1. The anode mounting member 16 of a fluorine electrolytic cell includes a plurality of annular (ring-shaped) packings 17 to 19 which surround a sidewall of the cylindrical anode packing gland 14 and are stacked along a longitudinal direction D thereof, a cylindrical exterior member 23 surrounding an outer periphery of the plurality of packings 17 to 19, and an annular fastening member 24 that fastens the plurality of packings 17 to 19 and the exterior member 23 to the anode packing gland 14. In addition, in order to fix the anode packing gland 14 more strongly, it is preferable that the annular fastening member 25 for directly fastening the anode packing gland 14 is further attached. The annular fastening member 25 serves as a stopper and has a function of preventing the anode packing gland 14 from sliding down along the longitudinal direction D.

Among the plurality of packings, the first packing 17 located at an end (the lowermost end in FIG. 2A) of the longitudinal direction D on the electrolyte tank side is formed of a ceramic material that does not cause a combustion reaction and has insulation in a mixed gas of fluorine and oxygen at normal pressure and around about 100° C. or lower. Examples of such a material can include one or two or more ceramic materials selected from alumina, calcium fluoride, potassium fluoride, yttria, and zirconia. It is preferable that Young's modulus of the first packing 17 is 100 GPa or more and 500 GPa or less.

It is preferable that a Vickers hardness of the first packing 17 is 5 or more and 30 or less.

A thickness of the first packing 17 is appropriately designed according to the influence on the seal, the durability of the material, and the like. The thickness of the first packing 17 is preferably 0.2 to 1.5 times, more preferably 0.3 to 1.0 times the inner diameter of the second packing 18. When the thickness is 0.2 times or more, problem in the durability of the material (easy to break) is not caused, and therefore such a thickness is preferable. When the thickness is 1.5 times or less, the production cost of packing does not increase, and this is preferable from an economic viewpoint. The thickness of the second packing 18 is appropriately designed according to the influence on the seal, the durability of the material, and the like. The thickness of the second packing 18 is preferably 1.0 mm to 10 mm, and more preferably 2.0 mm to 6.0 mm.

Among the plurality of packings, the second packing 18 adjacent to the first packing 17 in the longitudinal direction D is an insulator, and is made of a resin material that hardly reacts with fluorine at 100° C. or lower. Examples of such a material can include at least one or more resins selected from the group consisting of polytetrafluoroethylene, tetrafluoroethylene-perfluoroalkyl vinyl ether copolymer, tetrafluoroethylene-hexafluoropropylene copolymer, tetrafluoroethylene-ethylene copolymer, polyvinylidene fluoride, polychlorotrifluoroethylene, chlorotrifluoroethylene-ethylene copolymer, fluororubber, or polytetrafluoroethylene kneaded with calcium fluoride. The polytetrafluoroethylene is particularly preferable. One kind of these second packings may be used alone, and two or more kinds thereof may be used in combination.

A thickness of the second packing 18 is preferably 1 mm or more and 10 mm or less, more preferably 2 mm or more and 6 mm or less, and still more preferably approximately 5 mm. It is preferable that Young's modulus of the second packing 17 is 0.01 GPa or more and 2 GPa or less. A number of the second packings 18 can be optionally selected, and examples thereof include 1 or 2, or 1 to 5.

Among the plurality of packings, the plurality of third packings 19 other than the first packing 17 and the second packing 18 may have insulation and flexibility. For example, the third packing 19 is preferably made of Viton (trademark) (fluororubber), natural rubber, neoprene (trademark) rubber, or the like. In addition, it is preferable that each of the packings has a thickness of 1 mm or more, and further, the total thickness of the plurality of sheets is approximately 3 to 4 times the second packing.

Among the plurality of packings, on the third packing 19 located at the other end (the uppermost end in FIG. 2A), an annular sleeve base washer 20, an insulating sleeve 21, and a metal sleeve 22 are further stacked so that the central axis thereof aligns substantially with that of the anode packing gland 14. Specifically, the sleeve base washer 20 is laminated on the other end side of the third packing 19 (the uppermost end in FIG. 2A). The insulating sleeve 21 and the metal sleeve 22 are laminated on the sleeve base washer 20 as shown in the figure. Furthermore, a second sleeve base washer 20 is stacked on them via the fastening member 24.

The insulating sleeve (Bakelite sleeve) 21 is a member for electrically insulating the anode packing gland 14 from the metal sleeve 22, and is disposed between the anode packing gland 14 and the metal sleeve 22. The thickness (length) of the insulating sleeve 21 is preferably larger than the metal sleeve 22. For example, when the thickness of the metal sleeve 22 is 20 mm, it is more preferable that the thickness of the insulating sleeve 21 is approximately 22 mm which is 2 mm larger than the metal sleeve. The insulating sleeve 21 may be an integral member or a composite member obtained by combining a plurality of members. There may be a gap between the insulating sleeve 21 and the metal sleeve 22. Any constituent material of the insulating sleeve 21 can be selected, and examples thereof include a Teflon tube, vinyl chloride, and a phenol resin.

The metal sleeve (steel sleeve) 22 is a member for pressing the packing and the like on a lower layer side together with the fastening member 24. Dimensions of the metal sleeve 22 are not particularly limited. The metal sleeve 21 may be an integral member or a composite member obtained by combining a plurality of members. Any constituent material of the metal sleeve 22 can be selected, and examples thereof include iron materials having a predetermined hardness such as stainless steel (SUS) and carbon steel (CS).

The sleeve base washer 20 is an insulating member made of a hard resin. A thickness of the sleeve base washer 20 is preferably 3 mm or more from the viewpoint of obtaining strength. Any constituent material of the sleeve base washer 20 can be selected, and examples thereof include Teflon (registered trademark), wood, and phenol resin.

Table 1 shows an example of the inner diameter dimension and the outer diameter dimension of each of the first packing 17 and each member on the first packing 17 before being attached to the position of each layer. Here, a case where polytetrafluoroethylene (PTFE) is used as the second packing, and a case where Neoprene (trademark) is used as the third packing are exemplary examples. In addition, in this example, the outer diameter of the anode packing gland to be attached is 20 mm, and the inner diameter of the exterior member is 40.5 mm.

TABLE 1

| | Inner diameter | Outer diameter | Thickness |
|---|---|---|---|
| Insulating sleeve (Bakelite sleeve) | ϕ20 +0.2 mm −0.0 mm | ϕ30 +0.0 mm −0.2 mm | 22 mm |
| Metal sleeve (steel sleeve) | ϕ30 ±0.2 mm | ϕ40.5 +0.0 mm −0.2 mm | 20 mm |

TABLE 1-continued

| | Inner diameter | Outer diameter | Thickness |
|---|---|---|---|
| Sleeve base washer (Bakelite) | ϕ20 +0.2 mm −0.0 mm | ϕ40.5 +0.0 mm −0.2 mm | 6 mm |
| Third packing (Neoprene) | ϕ20 ±0.1 mm | ϕ40.5 ±0.1 mm | 5 mm |
| Second packing (Polytetrafluoroethylene) | ϕ20 +0.1 mm −0.0 mm | ϕ40.5 ±0.1 mm | 6 mm |
| First packing (Alumina ceramic) | ϕ20.6 mm | ϕ39.9 mm | 10 mm |

Any inner diameter of the exterior member can be selected, but the inner diameter of the exterior member is preferably 1.5 to 2.5 times, more preferably 1.8 to 2.2 times the outer diameter of the anode packing gland. When the inner diameter is 1.5 times or more, a packing width will not be narrowed, a distance between the anode packing gland 14 and the exterior member 23 will not be shortened, and deterioration of insulation performance which may be caused when electrolyte adheres to the gap between them will be prevented, which are preferable. When the inner diameter is 2.5 times or less, a contact area between packing and a packing seat 23*a* does not become too large, and it is not necessary to tighten with a very large torque in order to maintain hermetic performance, and the screw thread is not damaged, which are preferable.

The width of the packing seat 23*a*, that is, a width of a position which contacts the exterior member 23 on a bottom surface of the first packing in a case where the first packing has a donut shape is preferably 0.1 to 0.8 times, and more preferably 0.4 to 0.6 times the half of the difference value between the outer diameter and the inner diameter of the second packing. When the width is 0.1 times or more, the width of the packing seat 23*a* is not too narrow, and the sealing performance does not deteriorate, which are preferable. In addition, when the width is 0.8 times or less, the distance between the exterior member 23 and the anode packing gland 14 does not become too close, and deterioration of insulation performance which may be caused when electrolyte adheres to the gap between them will be prevented, which are preferable.

Any material of the exterior member 23 can be selected as necessary, and examples thereof can include carbon steel. A nut (fastening member) 24 is screwed onto an outer wall surface of the exterior member 23, and is attached so that the nut can move along the longitudinal direction D of the anode packing gland by rotating. By fastening the nut 24 from the top portion 22*a* side of the metal sleeve, the metal sleeve 22, the sleeve base washer 20, the third packing 19, and the second packing 18 are sequentially compressed in a thickness direction and expands radially perpendicular to the thickness direction. As a result, there is no gap between the third packing 19 and the anode packing gland 14 and between the third packing 19 and the exterior member 23, and the structure thereof is airtight.

The electrolyte tank 12 and the exterior member 23 are electrically connected. However, the electrolyte tank 12 and the exterior member 23, and anode packing gland 14 and the anode body 13 are insulated from each other via the sleeve base washer 20, insulating sleeve 21, the first packing 17, the second packing 18, and the third packing 19.

FIG. 2B is a view enlarging a cross section of the anode mounting member 16 of a fluorine electrolytic cell in FIG. 2A, taken along line A-A'. An inner diameter 17*r* of the first packing is 0.2 mm to 1.0 mm (preferably 0.4 mm to 0.8 mm) larger than the outer diameter 14R of the anode packing gland. In addition, the outer diameter 17R of the first packing is 0.2 mm to 1.0 mm (preferably 0.4 mm to 0.8 mm) smaller than the inner diameter 23*r* of the exterior member.

Furthermore, the central axes of the anode packing gland 14 and the exterior member 23 are configured to substantially coincide within a range of 0.1 mm or less. The eccentricity of the three central axes is preferably as small as possible. For example, between the anode packing gland 14 and the first packing 17 and between the first packing 17 and the exterior member 23, padding (such as metal thin wire) that can be pulled out later is inserted as a spacer at the time of attachment. Accordingly, the degree of eccentricity between the central axis of the anode packing gland 14 and the exterior member 23 and the central axis of the first packing 17 can be reduced. In addition, the degree of eccentricity can be similarly reduced by providing a step on the surface 23*a* of the packing seat that supports the first packing 17 so that the anode packing gland 14 side is recessed and placing the first packing 17 in the recessed portion.

That is, the maximum value of a distance $d_1$ between an outer wall of the anode packing gland 14 and an inner wall of first packing 17 and the maximum value of a distance $d_2$ between an outer wall of the first packing 17 and an inner wall of the exterior member 23 are both 0.2 mm or more and 1.0 mm or less and preferably 0.4 mm or more and 0.8 mm or less.

If the maximum value of each of distance $d_1$ and $d_2$ is 0.2 mm or more, even in a case where the second packing 18 expands in the thickness direction due to the fluorine gas containing oxygen gas generated at the initial stage of electrolysis, it is possible to prevent a stress generated in the first packing 17 due to the expanding from increasing and to prevent stress cracking of the first packing from occurring.

In addition, in a case where the maximum value of each of distance $d_1$ and $d_2$ is within the range of 1.0 mm or less, the combustion reaction due to the mixed gas and the second packing does not easily occur. Therefore, flame does not occur and the second packing is prevented from being burned. Thus, the upper limit value is estimated to correspond to an extinguishing distance of the mixed gas.

As described above, an mounting member of a fluorine electrolytic cell anode according to the present embodiment is used by attaching to the fluorine electrolytic cell, thereby preventing the first packing from being damaged by the fluorine gas generated at the initial stage of electrolysis, the second packing from being burned, and the fluorine from leaking to the outside of the anode chamber sufficiently, and it is possible to produce the fluorine gas stably by electrolysis for a long period of time from the initial stage of electrolysis.

EXAMPLES

Hereinafter, the present invention will be described in more detail, based on Examples and Comparative Examples. The present invention is not limited to the following Examples, but can be performed with appropriate modifications within the scope without changing the gist thereof.

Comparative Example 1

An anode mounting member of a fluorine electrolytic cell was prepared in substantially the same manner as the embodiment shown in FIG. 1, 2A, or 2B. Specifically, an anode mounting member of a fluorine electrolytic cell was prepared in which the first packing is provided in a portion where a bottom part of the packing structure portion is in contact with the mixed gas of fluorine gas and oxygen gas generated by electrolysis, and on a top portion thereof, as a structure for holding the electrode, a second packing, a third packing (neoprene rubber), a sleeve base washer (Bakelite), a metal sleeve, and an insulating sleeve were provided.

This mounting member was attached to a fluorine electrolytic cell to produce fluorine gas. As the first packing 17, packing made of alumina was used, and as the second packing, packing made of polytetrafluoroethylene was used.

The present example is different from the above embodiment in the following points regarding the difference in size with respect to the first packing and peripheral members thereof. That is, when the central axis of each of the first packing and the second packing were aligned, the inner diameter of the first packing was selected to be 0.1 mm larger than the inner diameter of the second packing, and the outer diameter of the first packing was selected to be 0.1 mm smaller than the outer diameter of the second packing. Thus, the inner diameter of the first packing was 0.1 mm larger than the outer diameter of the anode packing gland, and the outer diameter of the first packing was 0.1 mm smaller than the inner diameter of the exterior member. Therefore, the maximum value of the distance $d_1$ between the inner wall of the first packing and the outer wall of the anode packing gland and the maximum value of the distance $d_2$ between the outer wall of the first packing and the inner wall of the exterior member were both 0.1 mm.

An electrolytic cell having 48 anode mounting members was used. Each anode mounting member was tightened and attached to the electrode. In the electrolytic cell, about 1.5 t of KF-2HF molten salt containing about 0.5 wt % of water was contained, and electrolysis by energization was performed at an electrolysis temperature of 90° C. while supplying hydrogen fluoride thereto as needed. The energization was performed by gradually increasing the magnitude of the current from about 1000 A until reaching 5000 A, and the total amount of charge flowed was set to 100 KAH (kiloampere hours).

The gas generated at an anode during electrolysis was a mixed gas of fluorine gas and oxygen gas. When energization was stopped and the electrolytic cell was disassembled and the anode mounting member was confirmed, the first packing made of alumina ceramic was damaged at 24 locations. Among the 24 locations, there are 2 locations in the anode mounting members of a fluorine electrolytic cell where a defective portion is formed, and a portion of the second packing that is in contact with the mixed gas of fluorine gas and oxygen gas through the defective portion was burned out.

Comparative Example 2

In the present example, the inner diameter of the first packing was 2.0 mm larger than the outer diameter of the anode packing gland, and the outer diameter of the first packing was 2.0 mm smaller than the inner diameter of the exterior member. Otherwise, an anode mounting member of a fluorine electrolytic cell having the same configuration as that of Comparative Example 1 was attached to the fluorine electrolytic cell to produce fluorine gas.

The electrolysis by energization was performed by gradually increasing the magnitude of the current from about 1000 A until reaching 4000 A. When the total charge flowed was 70 KAH (kiloampere hours), the fluorine gas leaked from one of the anode mounting members.

At this stage, energization was stopped, and the fluorine electrolytic cell was disassembled to confirm a state of the anode mounting member. As a result, in all the anode mounting members, the first packing (alumina ceramic) was not damaged. However, in some anode mounting members, a large burning in the second packing (polytetrafluoroethylene) was confirmed, as a start from the gap portion (inner wall portion) in the first packing, in contact with the mixed gas of fluorine gas and oxygen gas. It is presumed that leakage of fluorine gas occurred through this burned portion.

Example 1

In the present example, the inner diameter of the first packing was 0.6 mm larger than the outer diameter of the anode packing gland, and the outer diameter of the first packing was 0.6 mm smaller than the inner diameter of the exterior member. Otherwise, an anode mounting member of a fluorine electrolytic cell having the same configuration as that of Comparative Example 1 was attached to the fluorine electrolytic cell to produce fluorine gas.

Electrolysis by energization was performed in the same procedure as in Comparative Examples 1 and 2. That is, the energization was performed by gradually increasing the magnitude of the current from about 1000 A until reaching 5000 A, and the total amount of charge flowed was set to 100 KAH (kiloampere hours).

The energization was stopped, and the fluorine electrolytic cell was disassembled to confirm a state of the anode mounting member. As a result, the first packing and the second packing of all anode mounting members remained in the state of being attached, and no defect was observed.

Example 2

In the present example, the inner diameter of the first packing was 1.0 mm larger than the outer diameter of the anode packing gland, and the outer diameter of the first packing was 1.0 mm smaller than the inner diameter of the exterior member. Otherwise, an anode mounting member of a fluorine electrolytic cell having the same configuration as that of Comparative Example 1 was attached to the fluorine electrolytic cell to produce fluorine gas.

The electrolysis by energization was performed by gradually increasing the magnitude of the current from about 1000 A until reaching 5000 A. At a stage in which the total charge flowed was 100 KAH (kiloampere hours), the current further flowed and energization was performed until the charge is in 30000 KAH.

The energization was stopped, and the fluorine electrolytic cell was disassembled to confirm a state of the anode mounting member. As a result, the first packing and the second packing of all anode mounting members remained in the state of being attached, and no defect was observed.

In Examples 1 and 2, the maximum values of two distances $d_1$ and $d_2$ were both 0.2 mm or more. Therefore, even in a case where the second packing expands in the thickness direction due to the fluorine gas containing oxygen gas generated at the initial stage of electrolysis, it is estimated that it is possible to prevent a pressure caused by the expanding from acting directly on the first packing and to prevent stress cracking of the first packing from occurring.

In addition, in Examples 1 and 2, the maximum values of two distances $d_1$ and $d_2$ were both 1.0 mm or less. Therefore, the width is shorter than the extinguishing distance of the fluorine gas containing oxygen gas, and the combustion reaction due to the mixed gas and second packing does not occur. Accordingly, it is presumed that no flame is generated and the second packing can be prevented from burning.

INDUSTRIAL APPLICABILITY

The present invention can be widely used as a technique of preventing fluorine from leaking from a manufacturing apparatus, in the process of producing fluorine by electrolysis.

REFERENCE SIGNS LIST

10 . . . Fluorine electrolytic cell
11 . . . Electrolyte
12 . . . Electrolyte tank
13 . . . Anode body
14 . . . Anode packing gland
14R . . . Anode packing gland outer diameter
15 . . . Anode body fastening member
16 . . . Anode mounting member of fluorine electrolytic cell
17 . . . First packing
17R . . . Outer diameter of first packing
17*r* . . . Inner diameter of first packing
18 . . . Second packing
19 . . . Third packing
20 . . . Sleeve base washer
21 . . . Insulating sleeve
22 . . . Metal sleeve
22*a* . . . Top portion of metal sleeve
23 . . . Exterior member
23*a* . . . Surface of packing seat
23*r* . . . Inner diameter of exterior member
24 . . . Fastening member (nut)
25 . . . Fastening member
D . . . Longitudinal direction
$d_1$ . . . Distance between first packing and anode packing gland
$d_2$ . . . Distance between first packing and exterior member

The invention claimed is:

1. An anode mounting member of a fluorine electrolytic cell comprising:

a plurality of annular packings which surround a sidewall of a cylindrical anode packing gland and are stacked along a longitudinal direction thereof;

a cylindrical exterior member which surrounds an outer periphery of the packings; and an annular fastening member which fastens the packings and the exterior member to the anode packing gland, wherein among the packings, a first packing which is located at an end of the longitudinal direction on an electrolyte tank side is made of a ceramic material, and a second packing which is adjacent to the first packing is made of resin, central axes of the anode packing gland and the exterior member coincide, an inner diameter of the first packing is 0.2 mm to 1.0 mm larger than an outer diameter of the anode packing gland, and an outer diameter of the first packing is 0.2 mm to 1.0 mm smaller than an inner diameter of the exterior member.

2. The anode mounting member of a fluorine electrolytic cell according to claim 1, wherein the first packing is made of one or more ceramic materials selected from alumina, calcium fluoride, potassium fluoride, yttria, and zirconia.

3. The anode mounting member of a fluorine electrolytic cell according to claim 1, wherein the second packing is made of at least one or more resins selected from the group consisting of polytetrafluoroethylene, tetrafluoroethylene-perfluoroalkyl vinyl ether copolymer, tetrafluoroethylene-hexafluoropropylene copolymer, tetrafluoroethylene-ethylene copolymer, polyvinylidene fluoride, polychlorotrifluoroethylene, chlorotrifluoroethylene-ethylene copolymer, and fluororubber.

4. A fluorine electrolytic cell comprising:

the anode mounting member of a fluorine electrolytic cell according to claim 1.

5. A method for producing fluorine gas, wherein the fluorine electrolytic cell according to claim 4 is used.

6. The anode mounting member of a fluorine electrolytic cell according to claim 1, wherein a thickness of the first packing is 0.2 to 1.5 times an inner diameter of the second packing.

7. The anode mounting member of a fluorine electrolytic cell according to claim 1, wherein a thickness of the second packing is 1.0 mm to 10 mm.

8. The fluorine electrolytic cell according to claim 4, comprising:

an anode;

a cylindrical anode packing gland; and an electrolyte tank.

9. The method for producing fluorine gas according to claim 5, comprising:

a step of electrolyzing a KF-2HF electrolyte to generate fluorine gas from an anode and hydrogen gas from a cathode.

10. The method for producing fluorine gas according to claim 9, further comprising:

a step of replenishing hydrogen fluoride to the electrolyte.

11. The method for producing fluorine gas according to claim 9, wherein oxygen is generated together with the fluorine gas.

* * * * *